US005480285A

United States Patent [19]

Patel et al.

[11] Patent Number: 5,480,285

[45] Date of Patent: Jan. 2, 1996

[54] STEAM TURBINE BLADE

[75] Inventors: Ashok T. Patel, Orlando; Daniel R. Cornell, Oviedo; James F. Lydon, Winter Park, all of Fla.

[73] Assignee: Westinghouse Electric Corporation, Pittsburgh, Pa.

[21] Appl. No.: 290,509

[22] Filed: Aug. 15, 1994

Related U.S. Application Data

[63] Continuation of Ser. No. 109,899, Aug. 23, 1993, abandoned.

[51] Int. Cl.[6] ..... F01D 5/14

[52] U.S. Cl. ..... 416/223 A; 416/248; 416/DIG. 5

[58] Field of Search ..... 416/219 R, 248, 416/223 RA, DIG. 5

[56] References Cited

U.S. PATENT DOCUMENTS

| | | | |
|---|---|---|---|
| 2,660,401 | 11/1953 | Hull, Jr. | 416/223 A |
| 3,045,968 | 7/1962 | Willis | 253/77 |
| 3,756,745 | 9/1973 | Alver et al. | 416/230 |
| 4,260,331 | 4/1981 | Goodwin | 416/219 R |
| 4,671,738 | 6/1987 | Freeman | 416/223 A |
| 4,686,796 | 8/1987 | Giebmanns | 416/223 A |
| 4,692,976 | 9/1987 | Andrews | 416/219 R |
| 4,696,621 | 9/1987 | Hamblett et al. | 416/223 A |
| 4,765,046 | 8/1988 | Partington et al. | 29/156.8 R |
| 4,824,328 | 4/1989 | Pisz et al. | 416/219 R |
| 4,900,230 | 2/1990 | Patel | 416/223 A |
| 4,919,593 | 4/1990 | Brown | 416/223 A |
| 5,088,894 | 2/1992 | Patel | 416/219 R |
| 5,149,180 | 9/1992 | Johnson | 416/223 A |
| 5,160,242 | 11/1992 | Brown | 416/219 R |
| 5,167,489 | 12/1992 | Wadia et al. | 416/223 A |
| 5,176,500 | 1/1993 | Heinig | 416/219 R |
| 5,242,270 | 9/1993 | Partington et al. | 416/219 R |
| 5,277,549 | 1/1994 | Chen et al. | 416/223 |

FOREIGN PATENT DOCUMENTS

| | | | |
|---|---|---|---|
| 950557 | 10/1956 | Germany . | |
| 2512347 | 9/1975 | Germany . | |
| 2650433 | 12/1977 | Germany | 416/223 A |
| 74706 | 6/1977 | Japan | 416/223 A |
| 954573 | 8/1982 | U.S.S.R. | 416/223 A |
| 325860 | 10/1920 | United Kingdom | 416/223 A |
| 677142 | 8/1952 | United Kingdom . | |
| WO87/00778 | 2/1987 | WIPO . | |

*Primary Examiner*—John T. Kwon
*Attorney, Agent, or Firm*—M. G. Panian

[57] ABSTRACT

A steam turbine blade having an airfoil portion and root portion by which the blade is affixed to a rotor. The geometry of the blade airfoil is configured to minimize energy loss through the row of blades and reduce the weight of the airfoil. The airfoil has a leading edge and a trailing edge defining a chord therebetween. The chord is reduced linearly from the base of the airfoil to 50% of the airfoil height. However, the chord remains essentially constant from 50% of the airfoil height to the airfoil tip. The root is fir tree shaped and has four sets of tangs and grooves that are configured to minimize the stresses in the root.

19 Claims, 7 Drawing Sheets

STEAM TURBINE BLADE

This application is a continuation of application Ser. No. 08/109,899 filed Aug. 23, 1993, now abandoned.

BACKGROUND OF THE INVENTION

The present invention relates to blades for a steam turbine rotor. More specifically, the present invention relates to a blade for use in the last stage in a low pressure steam turbine.

The steam flow path of a steam turbine is formed by a stationary cylinder and a rotor. A large number of stationary vanes are attached to the cylinder in a circumferential array and extend inward into the steam flow path. Similarly, a large number of rotating blades are attached to the rotor in a circumferential array and extend outward into the steam flow path. The stationary vanes and rotating blades are arranged in alternating rows so that a row of vanes and the immediately downstream row of blades forms a stage. The vanes serve to direct the flow of steam so that it enters the downstream row of blades at the correct angle. The blade airfoils extract energy from the steam, thereby developing the power necessary to drive the rotor and the load attached to it.

The amount of energy extracted by each row of rotating blades depends on the size and shape of the blade airfoils, as well as the quantity of blades in the row. Thus, the shapes of the blade airfoils are an extremely important factor in the thermodynamic performance of the turbine and determining the geometry of the blade airfoils is a vital portion of the turbine design.

As the steam flows through the turbine its pressure drops through each succeeding stage until the desired discharge pressure is achieved. Thus, the steam properties— that is, temperature, pressure, velocity and moisture content—vary from row to row as the steam expands through the flow path. Consequently, each blade row employs blades having an airfoil shape that is optimized for the steam conditions associated with that row. However, within a given row the blade airfoil shapes are identical, except in certain turbines in which the airfoil shapes are varied among the blades within the row in order to vary the resonant frequencies.

The blade airfoils extend from a blade root used to secure the blade to the rotor. Conventionally, this is accomplished by imparting a fir tree shape to the root by forming approximately axially extending alternating tangs and grooves along the sides of the blade root. Slots having mating tangs and grooves are formed in the rotor disc. When the blade root is slid into the disc slot, the centrifugal load on the blade, which is very high due to the high rotational speed of the rotor—typically 3600 RPM for a steam turbine employed in electrical power generation, is distributed along portions of the tangs, referred to as bearing areas, over which the root and disc are in contact. Because of the high centrifugal loading, the stresses in the blade root and disc slot are very high. It is important, therefore, to minimize the stress concentrations formed by the tangs and grooves and maximize the bearing areas over which the contact forces between the blade root and disc slot occur. This is especially important in the latter rows of a low pressure steam turbine due to the large size and weight of the blades in these rows and the presence of stress corrosion due to moisture in the steam flow.

In addition to the steady centrifugal loading, the blades are also subject to vibration at frequencies which coincide with integer multiples, referred to as harmonics, of the rotor rotational frequency. Such blade vibration can be excited by non-uniformities in the steam flow around the circumference of the turbine. Non-uniformities in the steam flow can result from the presence of extraction pipes and reinforcing ribs or imperfections in the shape and spacing of the stationary vanes. Thus, in steam turbines that are intended to operate at or very near a single rotational frequency, the blades are designed such that one or more of their resonant frequencies do not coincide with harmonics of rotor rotational frequency, referred to as "tuning."

The difficulty associated with designing a steam turbine blade is exacerbated by the fact that the airfoil shape determines, in large part, both the forces imposed on the blade and its mechanical strength and resonant frequencies, as well as the thermodynamic performance of the blade. These considerations impose constraints on the choice of blade airfoil shape so that, of necessity, the optimum blade airfoil shape for a given row is a matter of compromise between its mechanical and aerodynamic properties.

It is therefore desirable to provide a row of steam turbine blades that provides good thermodynamic performance while minimizing the stresses on the blade airfoil and root due to centrifugal force and avoiding resonant excitation.

SUMMARY OF THE INVENTION

Accordingly, it is the general object of the current invention to provide a row of steam turbine blades that provides good thermodynamic performance while minimizing the stresses on the blade airfoil and root due to centrifugal force and avoiding resonant excitation.

Briefly, this object, as well as other objects of the current invention, is accomplished in a turbo-machine comprising a turbo-machine having (i) a stationary cylinder for containing a steam flow, (ii) a rotor enclosed by the cylinder, and (iii) a row of blades affixed to the rotor. Each of the blades has an airfoil portion and a root portion. In addition, each of the airfoils has a leading edge and a trailing edge defining a chord therebetween. The airfoil has a base at its proximal end adjacent the root and a tip at its distal end and a mid-height region disposed mid-way between the base and the tip, the chord being essentially constant from the mid-height region to the tip. The chord at the mid-height region is less than one half of the chord at the base and decreases approximately linearly from the base to the mid-height region. Each of the roots has an uppermost tang, a next to uppermost tang, a lowermost tang, and a next to lowermost tang. In addition, each of the roots has an uppermost groove disposed above the uppermost tang, a next to uppermost groove disposed between the uppermost tang and the next to uppermost tang, a lowermost groove disposed between the next to lowermost tang and the lowermost tang, and a next to lowermost groove disposed between the next to lowermost tang and the next to uppermost tang. Each of the grooves is defined by a first concave section beginning at a first point and ending at second point and a second concave section beginning at third point and ending at fourth point, the first and second concave sections being connected by a tangent line extending between the second and third points. Each of the tangs is defined by a first straight section beginning at the fourth point and ending at a fifth point and a second straight section beginning at a sixth point and ending at an seventh point, and a third straight section beginning at an eighth point and ending at a ninth point, the first and second straight sections being joined by a first tangent convex section and the second and third straight sections being joined by a second tangent convex section.

DESCRIPTION OF THE PREFERRED EMBODIMENT

Figure 1:
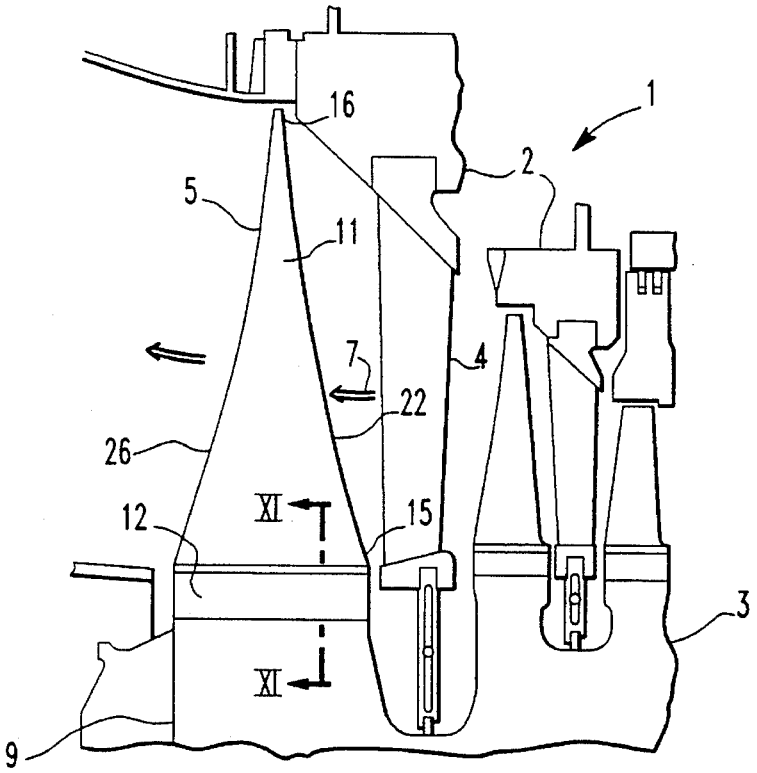
FIG. 1 is a portion of a cross-section through a steam turbine in the vicinity of the last row of blades according to the current invention.

Referring to the drawings, there is shown in FIG. 1 a portion of a cross-section through the low pressure section of a steam turbine 1. As shown, the steam flow path of the steam turbine 1 is formed by a stationary cylinder 2 and a rotor 3. A row of blades 5 are attached to the periphery of a disc 9 portion of the rotor 3 and extend radially outward into the flow path in a circumferential array. As shown in FIG. 1, the row of blades 5 is the last row in the low pressure steam turbine 1. A row of vanes 4 of a diaphragm structure are attached to the cylinder 2 and extend radially inward in a circumferential array immediately upstream of the row of blades 5. The vanes 4 have airfoils that cause the steam to undergo a portion of the stage pressure drop as it flows through the row of vanes. The vane airfoils also serve to direct the flow of steam 7 entering the stage so that the steam enters the row of blades 5 at the correct angle. The row of vanes 4 and the row of blades 5 together form a stage.

Figure 4:
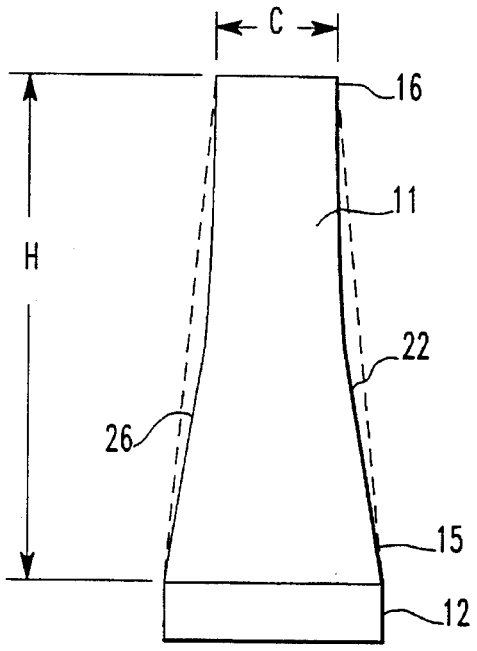
FIG. 4 is a view of the blade airfoil shown in FIG. 1 but with the airfoil untwisted so that the leading and trailing edges lie in a common plane so as to show the radial variation in the chord.

As shown in FIG. 1, each blade 5 is comprised of an airfoil portion 11 that extracts energy from the steam 7 and a root portion 12 that serves to fix the blade to the rotor 3. The airfoil 11 has a base portion 15 at its proximal end adjacent the root 12 in the hub region of the stage and a tip portion 16 at its distal end in the tip region of the stage. As shown in FIG. 1, the blades are of the free standing type—that is, they are unshrouded. In the preferred embodiment, the blade 5 is relatively large—i.e., the height H of the airfoil 11, indicated in FIG. 4, is approximately 91 cm (36 inches).

Figure 2:
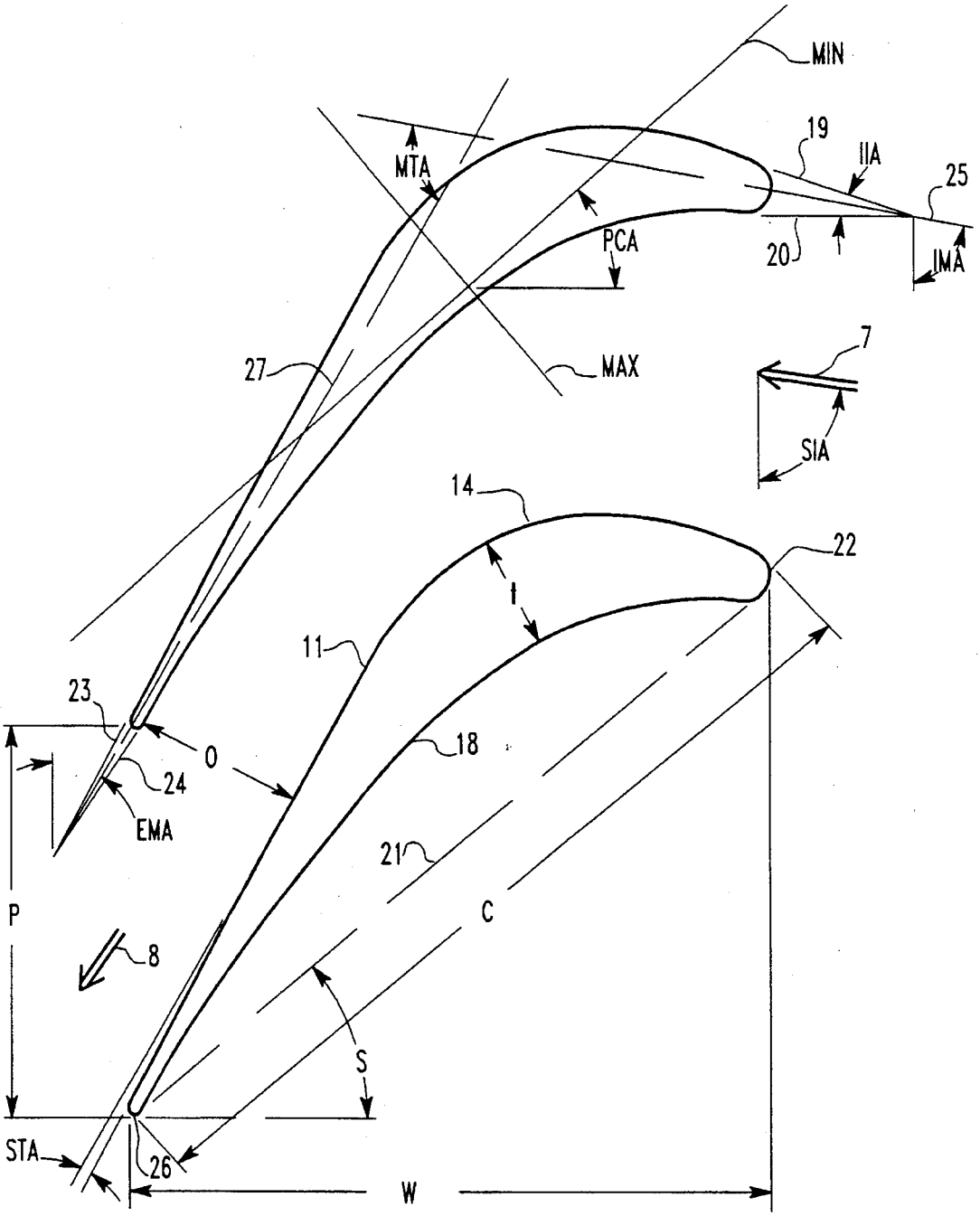
FIG. 2 is a diagram of two adjacent blades according to the current invention illustrating various performance related parameters.

The current invention concerns the airfoil 11 and the root 12 of the blade 5. More specifically, the current invention concerns a novel airfoil shape that minimizes the losses that the steam 7 flowing through the blade row experiences, thereby increasing the performance of the blade and the thermodynamic efficiency of the turbine, and that minimizes the weight of the airfoil, thereby reducing the forces on the base of airfoil and blade root due to centrifugal loading. Accordingly, FIG. 2 shows two adjacent blade airfoils 11 that form a portion of the blade row. Each airfoil has a leading edge 22, a trailing edge 26, a convex or suction surface 14 and a concave or pressure surface 18. The novel geometry of the airfoil 11 for the last row blade 5 of the current invention is specified in Table I by the relevant parameters, each of which is discussed below (all angles in Table I are expressed in degrees), and illustrated in FIG. 3.

In Table I, each parameter is specified at five radial stations along the airfoil—specifically, (i) at the base of the airfoil, corresponding to a radius of 71 mm (28 in) from the center line of the rotor, (ii) at 25% height, corresponding to a radius of 94 mm (37 in), (iii) at mid-height, corresponding to a radius of 116.8 mm (46 in), (iv) at 75% height, corresponding to a radius of 139.7 mm (55 in), and (v) at the tip of the airfoil corresponding to a radius of 162.6 mm (64 in). As those skilled in the art of blade design will appreciate, the values of the parameters shown in Table I for the radial station at the base of the airfoil do not correspond to the actual physical geometry of the blade but are based on extrapolations that are used by blade designers to define the airfoil geometry at its base. This is so because at the base of the airfoil a fillet is formed that distorts the actual values.

TABLE I

| | Blade Airfoil Characteristics | | | | |
|---|---|---|---|---|---|
| Parameter | Base | 25% | Mid | 75% | Tip |
| Radius, cm | 71.1 | 94.0 | 116.8 | 139.7 | 162.6 |
| Width, cm | 39.4 | 25.0 | 14.3 | 6.60 | 2.06 |
| Chord, cm | 39.4 | 25.5 | 19.0 | 18.4 | 18.5 |
| Pitch/Chord | 0.22 | 0.45 | 0.76 | 0.94 | 0.97 |
| Stagger Angle | 0.5 | 10.3 | 40.8 | 69.3 | 84.4 |
| Max Thickness, cm | 3.88 | 3.88 | 2.49 | 1.16 | 0.90 |
| Max Thickness/Chord | 0.10 | 0.15 | 0.13 | 0.06 | 0.05 |
| Max Thickness/Pitch | 0.44 | 0.34 | 0.17 | 0.07 | 0.05 |
| Turning Angle | 93.2 | 94.0 | 74.6 | 13.7 | 0.7 |
| Exit Opening, cm | 4.81 | 6.30 | 6.46 | 4.78 | — |
| Exit Opening Angle | 43.9 | 36.1 | 33.8 | 24.9 | — |
| Gauging | 0.55 | 0.54 | 0.45 | 0.28 | — |
| Inlet Metal Angle | 42.9 | 50.0 | 77.8 | 149.8 | 175.7 |
| Inlet Included Angle | 5.5 | 9.2 | 16.0 | 11.0 | 2.6 |
| Exit Metal Angle | 43.9 | 36.0 | 27.6 | 16.5 | 3.6 |
| Suction Surface Turning Angle | 0.0 | 0.1 | 2.8 | 8.4 | 1.9 |

The width of the blade refers to the distance from the leading to the trailing edge in the axial direction and is indicated by W in FIG. 2. The chord of the blade is the distance from the leading edge 22 to the trailing edge 26 and is indicated as C in FIG. 2. As discussed further below, the blade airfoil according to the current invention has a novel radial distribution of the chord C. The pitch is the distance in the tangential direction between the trailing edges of adjacent blades and is indicated in FIG. 2 as P. The pitch to chord ratio is an important parameter in determining the performance of a row of blades since there is an optimum value of this parameter that will yield the minimum blade loss—if the value is too large, meaning there are too few blades, then each blade will carry too much load and flow separation may occur, if the values are too low, meaning there are too many blades, the surface friction will become excessive. Consequently, these parameters are included in Table I.

The stagger angle is the angle that the line 21 drawn from the leading to the trailing edges makes with the axial direction and is indicated in FIG. 2 as S.

The maximum thickness refers to the thickest portion of the airfoil transverse cross-section and is indicated in FIG. 2 as t. The maximum thickness to chord ratio and the maximum thickness to pitch ratio are the ratios of the maximum thickness of the airfoil transverse cross-section at the radial station to the chord length and airfoil pitch at that station.

The turning angle is indicated as MTA in FIG. 2 and given by the equation MTA=180° −(IMA+EMA), where IMA and EMA are the inlet and exit metal angles, respectively, as defined below.

The exit opening, or throat, is the distance from the trailing edge 26 of one blade to the suction surface 14 of the adjacent blade along a line perpendicular to the suction surface and is indicated in FIG. 2 by 0. The exit opening is not indicated at the tip 16 since for the blade according to the current invention, the leading and trailing edges of adjacent blades at the tip are situated such that no perpendicular line can be drawn from the suction surface of one blade to the trailing edge 26 of the adjacent blade. The gauging of the blade row is defined as the ratio of the exit opening to the pitch and indicates the portion of the annular area available for steam flow.

The exit opening angle is the arc sin of the gauging.

The inlet metal angle is the angle formed between the circumferential direction and the line 25 that bisects the lines 19 and 20, lines 19 and 20 being the lines that are tangent with the suction surface 14 and the pressure surface 18, respectively, at the leading edge 22. The inlet metal angle is indicated in FIG. 2 as IMA.

The inlet included angle is the angle between the tangent lines 19 and 20 and is indicated in FIG. 2 as IIA. Selection of the inlet included angle involves a tradeoff since a large inlet included angle improves performance at off-design conditions, while a small inlet angle results in the optimum performance at design conditions.

The exit metal angle is the angle formed between the circumferential direction and the line 27 that bisects the lines 23 and 24, lines 23 and 24 being the lines that are tangent with the suction surface 14 and the pressure surface 18, respectively, at the trailing edge 26. The exit metal angle is indicated in FIG. 2 as EMA.

The suction surface turning angle is the amount of the suction surface 14 turning from the throat O to the trailing edge 26 and is indicated in FIG. 2 as STA. The optimum value for the suction surface turning angle depends on the Mach No. Too large an amount of turning can cause flow separation and too little turning will prevent the steam flow from accelerating properly. As can be seen, the suction surface turning angle has been maintained below 10° throughout the airfoil to ensure that boundary layer separation does not occur in the trailing edge 26 region.

Figure 3:
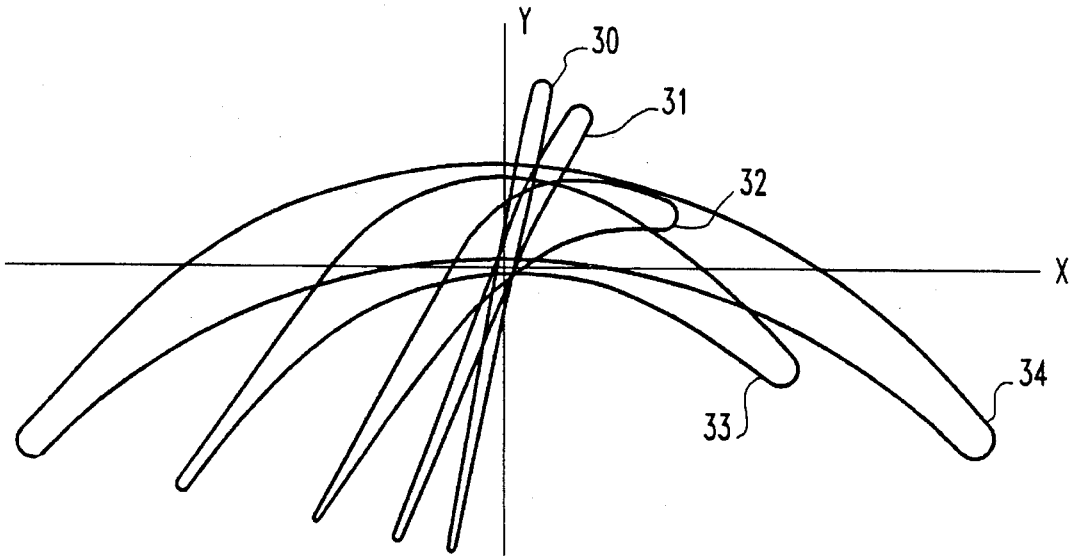
FIG. 3 is a series of transverse cross-sections through the blade airfoil shown in FIG. 1 at various radial locations.

The blade airfoil 11 according to the current invention is further defined by FIG. 3, a so-called "stacked plot" of the airfoil 11, which shows transverse cross-sections taken at the tip 16 of the airfoil as indicated by reference numeral 30, at 25% height as indicated by reference numeral 31, at mid-height as indicated by reference numeral 32, at 75% height as indicated by reference numeral 33, and at the base 15 of the airfoil as indicated by reference numeral 34.

In order to efficiently extract energy from the steam flow, the airfoil must have a certain minimum value for its chord. Traditionally, the minimum value of the chord occurred at the tip. Due to the increase in centrifugal and bending forces on the airfoil in going from the tip toward the base of the airfoil, the maximum chord generally occurred at the base of the airfoil where these forces are the greatest. In the past, this change in blade chord was typically effected by approximately linearly varying the chord from the base of the airfoil to its tip.

According to an important aspect of the current invention, the chord C is not varied linearly along the height H of the blade. Instead, almost all of the reduction in the chord C of the airfoil 11 occurs in the lower half of the airfoil. This novel shaping of the airfoil is not apparent in FIG. 1 because the twist distorts the side view of the airfoil profile. However, FIG. 4 shows a side view of the airfoil 11 as it would appear if the airfoil were untwisted so that the leading and trailing edges 22 and 26, respectively, lie in the same plane, thereby making the novel tapering according to the current invention apparent.

Figure 5:
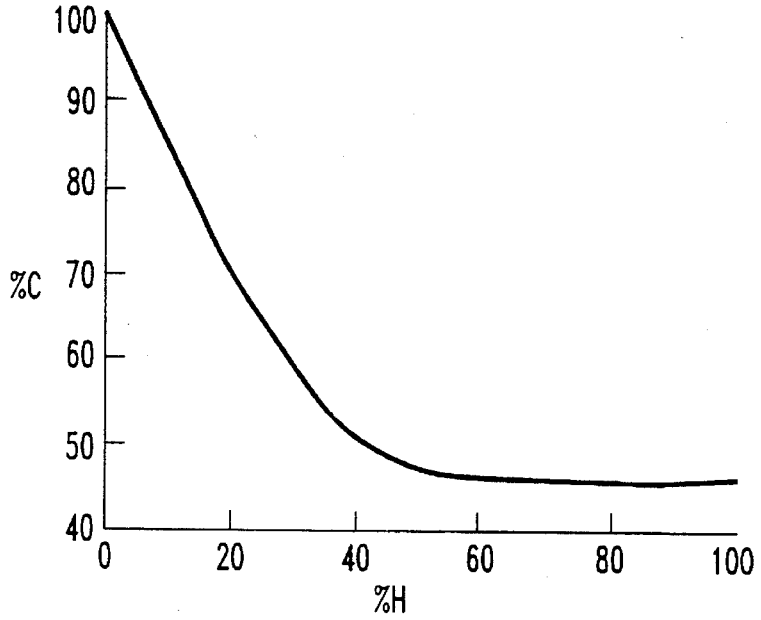
FIG. 5 is a graph showing the radial distribution of the chord C of the blade airfoil according to the current invention, expressed as a percentage of the chord at the base of the airfoil, from the airfoil base, at 0% height, to its tip, at 100% height.

FIG. 5 shows the radial distribution of the chord C as a percentage of the chord at the base 15 of the airfoil. As shown in FIGS. 4 and 5, the chord C undergoes an approximately linear reduction from the base 15 of the airfoil up to about 50% height, at which point it is less than one half of the chord at the base. However, from 50% height up to the tip 16 of the airfoil, the chord remains essentially constant—that is, it deviates by less than 5%.

The novel radial distribution of the chord C in the blade according to the current invention reduces the weight of the airfoil when compared with the traditional, approximately uniform, tapering of the chord, shown by the dashed lines in FIG. 4. This reduction in weight reduces the centrifugal force generated by the airfoil 11 and results in an advantageous reduction in the stress in the blade root 12.

Figure 6:
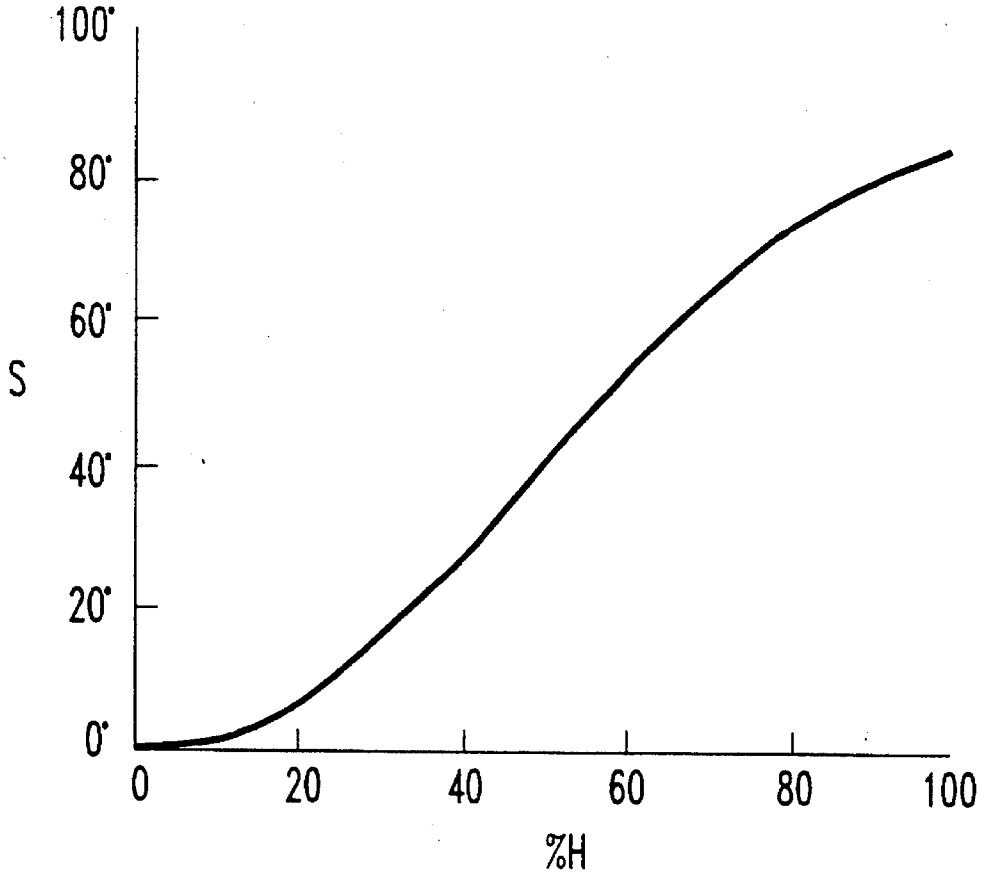
FIG. 6 is a graph showing the radial distribution of the stagger angle S, in degrees, for the blade airfoil shown in FIG. 1 from the base to the tip of the airfoil.

The blade airfoil 11 according to the current invention also exhibits a high degree of twist as it extends from the base 15 to the tip 16. This high degree of twist is indicated by the fact that the stagger angle S varies from approximately 0° at the base 15 of the airfoil to approximately 85° at the tip 16, as shown in FIG. 6, and can be readily seen in FIG. 3.

The novel shape of the blade airfoil 11 according to the current invention, as specified in Table I and illustrated in FIG. 3, allows the steam 7 to expand across the blade row with a minimum amount of energy loss. Significant losses in the blade row may occur due to friction losses as the steam flows over the airfoil surface and due to separation of the boundary layer on the suction surface 14 of the airfoil. In the blade airfoil shape of the current invention both of these sources of steam energy loss are minimized.

Figure 7:
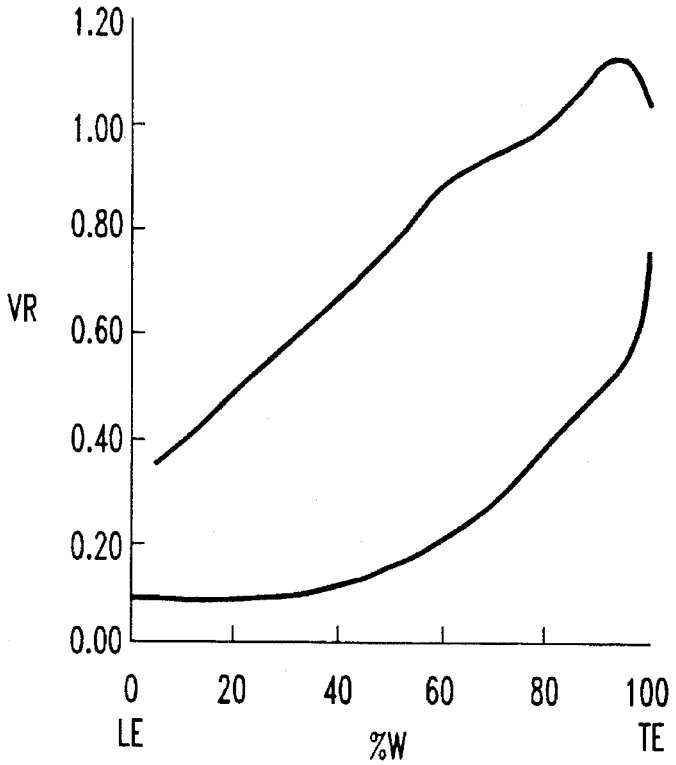
FIG. 7 is a graph showing the calculated axial distribution of the steam velocity ratio VR—that is, the local surface velocity to the blade row exit velocity—along the width W of the airfoil, from the leading edge LE to the trailing edge TE, over the blade suction surface, indicated by the upper curve, and the blade pressure surface, indicated by the lower curve, at mid-height for the blade airfoil shown in FIG. 1.

Friction losses are minimized by configuring the airfoil shape so as to maintain the velocity of the steam at relatively low values, as shown in FIG. 7. Specifically, FIG. 7 shows the velocity ratio—that is, the ratio of the steam velocity at the surface of the airfoil at mid-height to the velocity of the steam exiting the blade row at mid-height as it varies from the leading edge LE to the trailing edge TE. The upper curve represents the velocity ratio on the convex suction surface 14 and the lower curve represents the velocity ratio on the concave pressure surface 18. As shown in FIG. 7, the velocity ratios at mid-height, which is typical of the entire length of the airfoil, over the entire width of the airfoil is less than 1.2. Such advantageous velocity profiles are made possible by the blade surface contour, shown in FIG. 3.

FIG. 7 also shows that in the blade according to the current invention, separation of the boundary layer is prevented by configuring the airfoil geometry to ensure that the steam does not decelerate too rapidly as it expands toward the trailing edge 26 of the airfoil 11. As can be seen, the velocity ratio on the suction surface does not decrease greatly from its peak value of about 1.1, at approximately 90% blade width, to its value at the trailing edge TE, thereby ensuring that boundary layer separation, and the associated loss in steam energy, does not occur.

Figure 8:
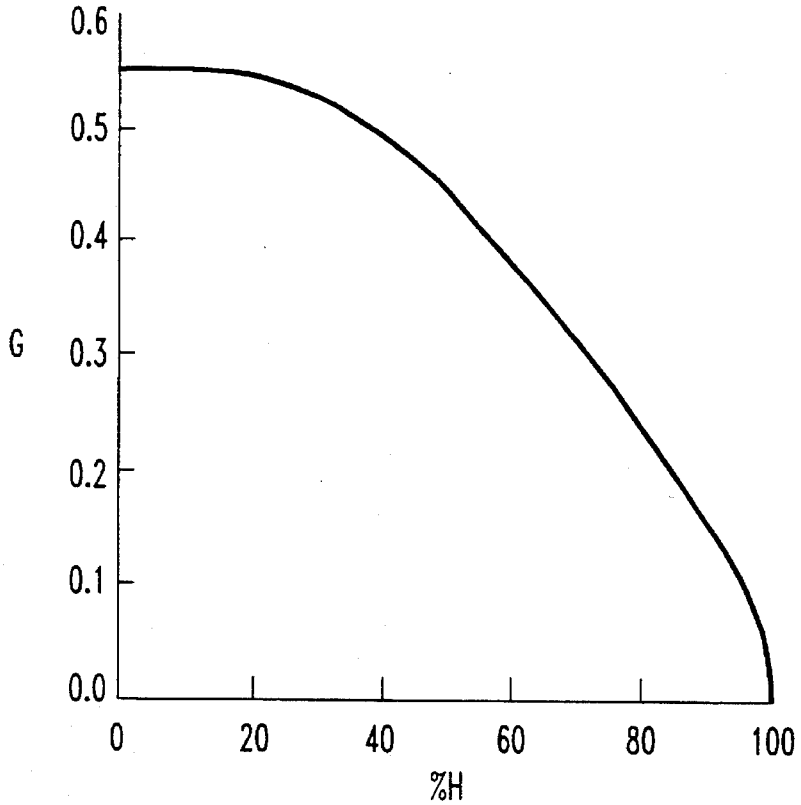
FIG. 8 is a graph showing the calculated radial distribution of the gauging G of the blade row according to the current invention from the base of the airfoil to its tip.

As shown in FIG. 8, in the blade of the current invention, the gauging G at the base of the airfoil is relatively high at about 0.55 and is maintained above 0.5 throughout the lower one-third of the blade height. Thereafter, the gauging decreases rapidly toward the tip of the airfoil. This radial gauging distribution, in which a large gauging is maintained in the lower portion of the airfoil, allows more steam to pass through the hub region of the stage and reduces the steam flow at the tip region. Thus is a desirable situation since it results in favorable exhaust hood performance downstream of the blade.

Figure 9:
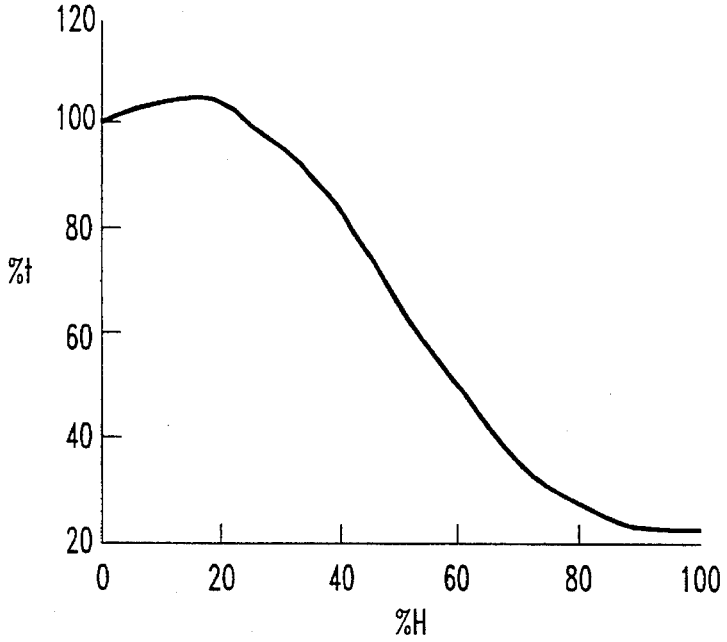
FIG. 9 is a graph showing the radial distribution of the maximum airfoil thickness from the base of the blade airfoil to its tip.

FIG. 9 shows the radial distribution of the maximum thickness t of the airfoil 11 as a percentage of its value at the airfoil base 15. As shown in FIG. 8, the maximum thickness t of the airfoil drops dramatically from about 106% at approximately 20% height to less than 30% at approximately 80% height. This thinning of the airfoil in its upper portion reduces the weight of the airfoil so as to reduce the centrifugal loading on the blade root 12.

The mechanical properties of the blade airfoil having the geometry defined in Table I are shown in Table II. The principal coordinate axes of the airfoil are indicated in FIG. 2 as MIN and MAX. The minimum and maximum second moments of inertia about these axes are shown in Table II as by $I_{min}$ and $I_{max}$, respectively, and the torsional moment of inertia is shown as $I_{tor}$. The radial distribution of $I_{min}$ and the cross-sectional area have a strong influence on the first vibratory mode. The radial distribution of $I_{max}$ and the cross-sectional area have a strong influence on the second vibratory mode. Hence, it is important that these values be adjusted so as to avoid resonance. The distances of the leading and trailing edges from the principal coordinate axes MIN and MAX are designed by $C_{min}$ and $C_{max}$, respectively. The angle the principal coordinate axis MIN makes with the axial direction is indicated in FIG. 2 as PCA. Note that except for the angle of the principal coordinate axes, the values shown in Table II are based on the geometry assumed by the blade during operation at design speed—i.e., 3600 RPM—taking into account the untwisting of the airfoil due to the centrifugal forces on the blade.

TABLE II

| | Blade Airfoil Mechanical Characteristics | | | | |
|---|---|---|---|---|---|
| Parameter | Base | 25% | Mid | 75% | Tip |
| Cross-sectional area, $cm^2$ | 124.0 | 67.4 | 28.8 | 12.7 | 11.0 |
| Angle of Principal Coordinate Axis | −0.6 | 5.3 | 42.9 | 70.8 | 85.2 |
| $I_{tor}$, $cm^4$ | 407 | 191 | 34 | 2.5 | 1.7 |
| $I_{min}$, $cm^4$ | 842 | 336 | 34 | 0.9 | 0.4 |
| $I_{max}$, | 128 | 23.7 | 5.7 | 3.1 | 2.7 |

TABLE II-continued

| | Blade Airfoil Mechanical Characteristics | | | | |
|---|---|---|---|---|---|
| Parameter | Base | 25% | Mid | 75% | Tip |
| $cm^4 \times 10^2$ | | | | | |
| $C_{min}$-LE, mm | −7.00 | −5.43 | −3.06 | −0.80 | −1.27 |
| $C_{max}$-LE, mm | 20.75 | 12.4 | 6.81 | 7.07 | 7.39 |
| $C_{min}$-TE, mm | −7.53 | −7.38 | −2.35 | −0.34 | −0.18 |
| $C_{max}$-TE, mm | −19.04 | −13.7 | −12.02 | −11.02 | −10.88 |

Figure 10:
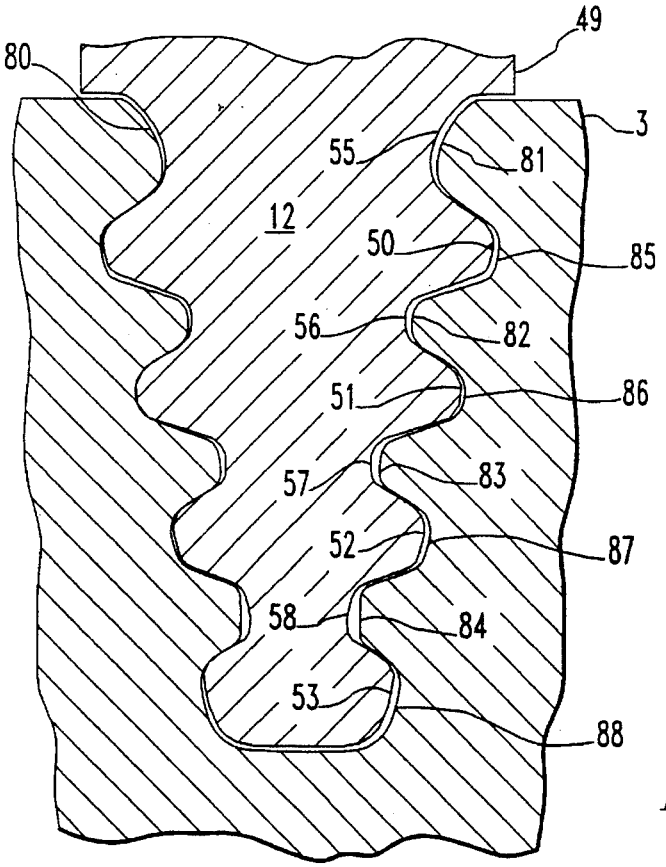
FIG. 10 is a transverse cross-section through the blade root and disc groove of the current invention taken through line XI—XI shown in FIG. 1.

In addition to the novel airfoil 11, the blade of the current invention also utilizes a novel root 12. As shown in FIG. 10, the blade root 12 has a fir tree shape comprising four tangs—specifically, an uppermost tang 50, a next to uppermost tang 51, a next to lowermost tang 52, and a lowermost tang 53. An uppermost groove 55 is disposed above the uppermost tang—specifically, between the airfoil platform 49 the upper tang 50. In addition, a next to the uppermost groove 56 is disposed between tangs 50 and 51, a next to lowermost groove 57 is disposed between tangs 51 and 2, and a lowermost groove 58 is disposed between tangs 52 and 3.

As shown in FIG. 10, the blade root 12 fits into a slot 80 in the periphery of the rotor disc 9 that has tangs 81–84 that correspond to the grooves 55–58 in the blade root and that has grooves 85–88 that correspond to the tangs 50–53 in the blade root. By closely controlling the contours and tolerances of the blade root 12 and disc slot 80, a portion of the upper surfaces of each of the blade root tangs 50–53 will bear against a portion of the lower surfaces of each of the disc slot tangs 85–88. Thus, the tangs 50–53 form bearing areas, having a width indicated by BA1 through BA4 in FIG. 11, over which the contact stress is distributed. Because of the large centrifugal forces imposed on the tangs of the blade root and disc groove due to the rotation of the rotor 3, as well as the vibratory forces imposed by the steam flow, it is important that the blade root 12 and disc slot 80 geometry be shaped so as to optimally absorb and distribute the forces by maximizing the bearing area and the strength of the root and by minimizing any stress concentrations. Accordingly, in the blade root according to the current invention, the root geometry has been optimized so as to maximize the bearing area and the strength of the root and so as to minimize stress concentrations. This is reflected, in part, in Table III, which shows the minimum root neck width, indicated by N1 to N4 in FIG. 11, between each of the blade root grooves 55–58, and the bearing width of each of the tangs 50–53. As can be seen, the root geometry according to the current invention provides a relatively wide root neck width to withstand the stress transferred from the tangs and relatively large bearing widths to absorb the contact stresses.

Figure 11:
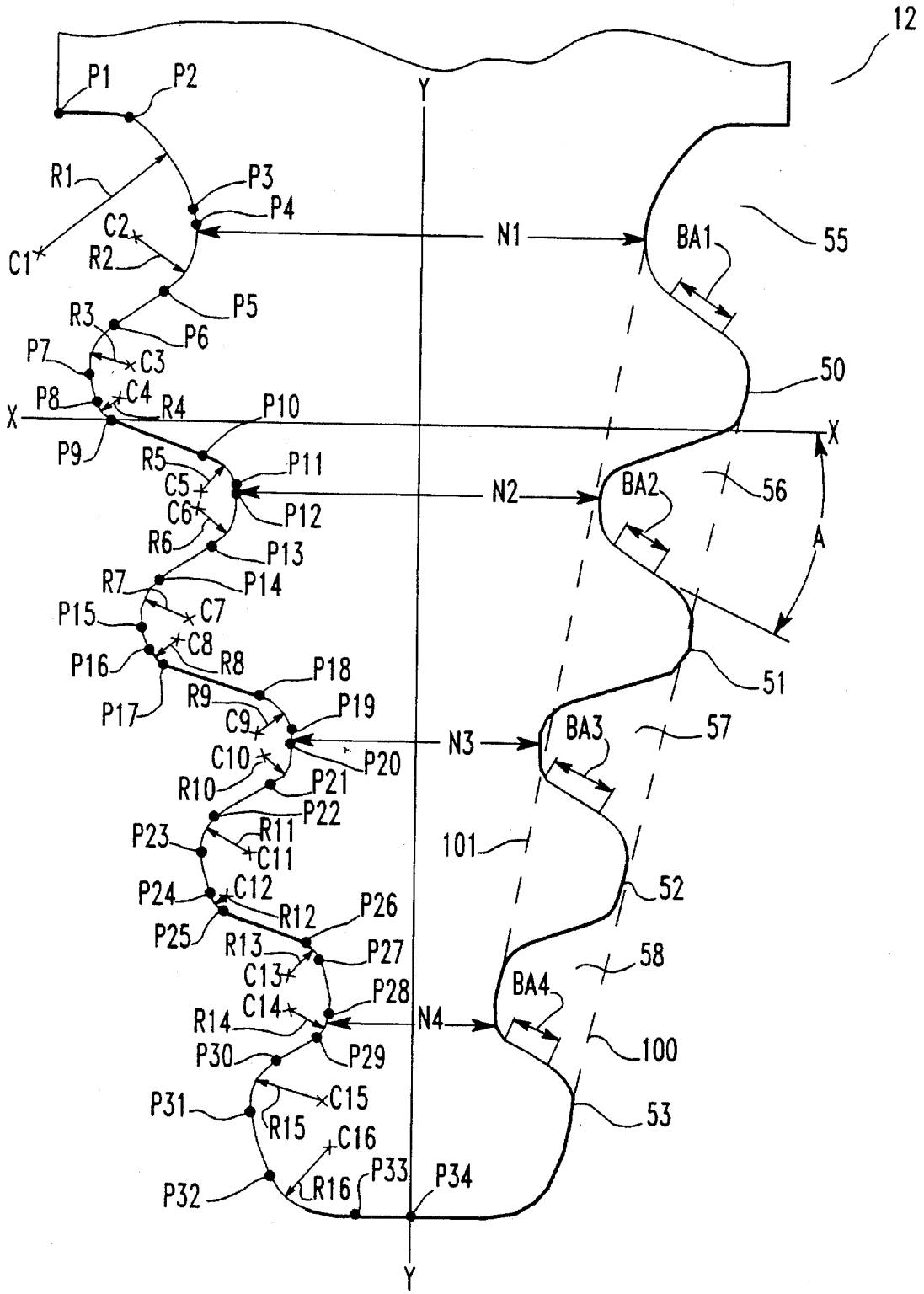
FIG. 11 is a detailed view of the blade root shown in FIG. 10.

According to the current invention, the angle A, shown in FIG. 11, that each tang bearing area, BA1 to BA4, makes with the X axis is approximately 30°. Too large an angel A and the friction force on the tang bearing area, which is a function of the angle the applied load makes with the bearing area, will become too large, rendering the root susceptible to surface damage. However, for a given blade root envelope, the smaller the angle A, the smaller the root neck width N that can be achieved for a given bearing area width BA since the neck width is a function of the bearing area width projected onto a plane parallel with the X-axis. Accordingly, the inventors have found that 30° is the optimum value for the angle A that the root tang bearing surfaces make with the X-direction.

TABLE III

| Location | Root Neck Width, $N_1$ (cm) | Bearing Width, $BA_i$ (cm) |
|---|---|---|
| Uppermost (i = 1) | 3.810 | 0.532 |
| Next to Uppermost (i = 2) | 3.058 | 0.493 |
| Next to Lowermost (i = 3) | 2.097 | 0.470 |
| Lowermost (i = 4) | 1.398 | 0.362 |

As shown in FIG. 11, according to the current invention, the uppermost groove 55 is defined by a first concave section beginning at P2 and ending at P3 and a second concave section beginning at P4 and ending at P5. The two concave section are connected by a tangent line extending between points P3 and P4. It should be noted that in the case of groove 55, the tangent line between P3 and P4 is very short and, in some embodiments, may be dispensed with. The first concave section has a radius of curvature R1 at center C1 and the second concave section has a radius of curvature R2 at center C2. The uppermost tang 50 is defined by a first straight section beginning and ending at P5 and P6, respectively, a second straight section beginning and ending at P7 and P8, respectively, and a third straight section beginning and ending at P9 and P10, respectively. The first and second straight sections are joined by a tangent convex section having a radius of curvature R3 at center C3 and the second and third straight sections are joined by a tangent convex section having a radius of curvature R4 at center C4.

The next to the uppermost groove 56 is defined by a first concave section beginning at P10 and ending at P11 and a second concave section beginning at P12 and ending at P13. The two concave section are connected by a tangent line extending between points P11 and P12. The first concave section has a radius of curvature R5 at center C5 and the second concave section has a radius of curvature R6 at center C6. The next to the uppermost tang 52 is defined by a first straight section beginning and ending at P13 and P14, respectively, a second straight section beginning and ending at P15 and P16, respectively, and a third straight section beginning and ending at P17 and P18, respectively. The first and second straight sections are joined by a tangent convex section having a radius of curvature R7 at center C7 and the second and third straight sections are joined by a tangent convex section having a radius of curvature R8 at center C8.

The next to the lowermost groove 57 is defined by a first concave section beginning at P18 and ending at P19 and a second concave section beginning at P20 and ending at P21. The two concave section are connected by a tangent line extending between points P19 and P20. The first concave section has a radius of curvature R9 at center C9 and the second concave section has a radius of curvature R10 at center C10. The next to the lowermost tang 53 is defined by a first straight section beginning and ending at P21 and P22, respectively, a second straight section beginning and ending at P23 and P24, respectively, and a third straight section beginning and ending at P25 and P26, respectively. The first and second straight sections are joined by a tangent convex section having a radius of curvature R11 at center C11 and the second and third straight sections are joined by a tangent convex section having a radius of curvature R12 at center C12.

The lowermost groove 58 is defined by a first concave section beginning at P26 and ending at P27 and a second concave section beginning at P28 and ending at P29. The two concave section are connected by a tangent line extending between points P27 and P28. The first concave section has a radius of curvature R13 at center C13 and the second concave section has a radius of curvature R14 at center C14. The lowermost tang 54 is defined by a first straight section beginning and ending at P29 and P30, respectively, a second straight section beginning and ending at P31 and P32, respectively, and a third straight section beginning and ending at P33 and P34, respectively. The first and second straight sections are joined by a tangent convex section having a radius of curvature R15 at center C15 and the second and third straight sections are joined by a tangent convex section having a radius of curvature R16 at center C16.

According to the current invention, the radii of curvature and the other aspects of the shape of the blade root 12 according to the current invention have been optimized to minimize the stresses in the root. Accordingly, Table IV shows the X–Y coordinate points that define the locations of the points P1 to P34 and Table V gives the value of the radii of curvature R1 to R16 and the corresponding X–Y coordinates of the centers C1 to C16 for these radii of curvature. Although the coordinates and radii are shown for only the left hand side of the root 12, as shown in FIG. 12, the root is symmetrical about the its radial centerline, defined by the Y-axis, so that Tables IV and V completely define the blade root 12 geometry. In one preferred embodiment of the invention, the value of the coordinate points and the radii show in Tables IV and V are expressed in inches. However, it should be understood that the blade root 12 according to the current invention may be scaled to greater or lesser sizes provided that the shape remains the same. Accordingly, the values for the coordinates and radii given in Tables IV and V should be considered as being non-dimensional.

TABLE IV

| Blade Root Coordinates | | |
|---|---|---|
| Point | X | Y |
| P1 | −1.250 | 1.083 |
| P2 | −1.002 | 1.083 |
| P3 | −.754 | 0.731 |
| P4 | −.753 | 0.730 |
| P5 | −.884 | 0.456 |
| P6 | −1.066 | 0.351 |
| P7 | −1.128 | 0.203 |
| PS | −1.101 | 0.092 |
| P9 | −1.035 | 0.021 |
| P10 | −0.686 | −0.094 |
| P11 | −0.604 | −0.201 |
| P12 | −0.602 | −0.226 |
| P13 | −0.697 | −0.402 |
| P14 | −0.865 | −0.499 |
| P15 | −0.934 | −0.694 |
| P16 | −0.914 | −0.747 |
| P17 | −0.852 | −0.806 |
| P18 | −0.502 | −0.922 |
| P19 | −0.422 | −1.014 |
| P20 | −0.416 | −1.046 |
| P21 | −0.493 | −1.214 |
| P22 | −0.654 | −1.306 |
| P23 | −0.727 | −1.478 |
| P24 | −0.700 | −1.592 |
| P25 | −0.634 | −1.664 |
| P26 | −0.382 | −1.747 |
| P27 | −0.301 | −1.838 |
| P28 | −0.278 | −1.959 |
| P29 | −0.340 | −2.096 |
| P30 | −0.464 | −2.168 |
| P31 | −0.547 | −2.361 |
| P32 | −0.511 | −2.515 |
| P33 | −0.253 | −2.719 |
| P34 | 0.000 | −2.719 |

TABLE V

| Blade Root Radii | | | |
|---|---|---|---|
| | | Center Coordinates | |
| Radius | Value | X | Y |
| R1 | 0.49 | −1.236 | 0.654 |
| R2 | 0.27 | −1.018 | 0.688 |
| R3 | 0.13 | −0.999 | 0.235 |
| R4 | 0.10 | −1.004 | 0.116 |
| R5 | 0.12 | −0.724 | −0.208 |
| R6 | 0.19 | −0.792 | −0.238 |
| R7 | 0.16 | −0.785 | −0.638 |
| R8 | 0.10 | −0.821 | −0.711 |
| R9 | 0.12 | −0.540 | −1.036 |
| R10 | 0.16 | −0.573 | −1.076 |
| R11 | 0.16 | −0.575 | −1.442 |
| R12 | 0.10 | −0.603 | −1.569 |
| R13 | 0.12 | −0.419 | −1.861 |
| R14 | 0.13 | −0.405 | −1.984 |
| R15 | 0.18 | −0.376 | −2.321 |
| R16 | 0.27 | −0.253 | −2.454 |

As can be seen from Table V, the grooves of the blade root 12 according to the current invention employs relatively large radii. This is important in maximizing the fatigue strength of the root.

Traditionally, the envelope within which the blade root tangs and grooves lie was defined by inner and outer straight lines, with the each tang and groove being tangent at its innermost and outermost point to these lines. However, as shown in FIG. 11, according to the current invention, the envelope within which the tangs and grooves lie is not defined by a straight line 100 extending between the uppermost and lowermost tangs and a straight line 101 extending between the uppermost and lowermost grooves. Instead, each tang and groove has been allowed to extend beyond the lines 100 and 101 or stop short of these lines as necessary to optimize the root geometry.

As previously discussed, the blade root 12 mates with a corresponding slot 80 in the disc 9. As shown in FIG. 10, the profile of the disc slot 80 is very similar to that of the blade root 12, with the disc slot profile being almost a mirror image of the root except for slight changes in the coordinates of the points P1 to P34 and in the values and centers for the radii R1 to R16.

As shown in FIG. 10, and with reference to FIG. 11 as an aid to understanding the location of the various points and radii (with the understanding that the disc slot 80 profile is approximately a mirror image of that of the root so that the disc material would be to the left of the profile marked by points P1 to P34 in FIG. 11), according to the current invention, the uppermost disc tang 81 is defined by a first straight section beginning and ending at P1 and P2, respectively, a second straight section beginning and ending at P3 and P4, respectively, and a third straight section beginning and ending at P5 and P6, respectively. It should be noted that in the case of tang 81, the second straight section is very short and, in some embodiments, may be dispensed with. The first and second straight sections are joined by a tangent convex section having a radius of curvature R1 at center Cl and the second and third straight sections are joined by a tangent convex section having a radius of curvature R2 at center C2. The uppermost disc groove 85 is defined by a first concave section beginning at P6 and ending at P7 and a second concave section beginning at P8 and ending at P9. The two concave section are connected by a tangent line, in the case of groove 85 extending between points P7 and PS. The first concave section has a radius of curvature R3 at center C3 and the second concave section has a radius of curvature R4 at center C4.

The next to the uppermost disc tang 82 is defined by a first straight section beginning and ending at P9 and P10, respectively, a second straight section beginning and ending at P11 and P12, respectively, and a third straight section beginning and ending at P13 and P14, respectively. The first and second straight sections are joined by a tangent convex section having a radius of curvature R5 at center C5 and the second and third straight sections are joined by a tangent convex section having a radius of curvature R6 at center C6. The next to the uppermost disc groove 86 is defined by a first concave section beginning at P14 and ending at P15 and a second concave section beginning at P16 and ending at P17. The two concave section are connected by a tangent line extending between points P15 and P16. The first concave section has a radius of curvature R7 at center C7 and the second concave section has a radius of curvature R8 at center C8.

The next to the lowermost disc tang 83 is defined by a first straight section beginning and ending at P17 and P18, respectively, a second straight section beginning and ending at P19 and P20, respectively, and a third straight section beginning and ending at P21 and P22, respectively. The first and second straight sections are joined by a tangent convex section having a radius of curvature R9 at center C9 and the second and third straight sections are joined by a tangent convex section having a radius of curvature R10 at center C10. The next to the lowermost disc groove 87 is defined by a first concave section beginning at P22 and ending at P23 and a second concave section beginning at P24 and ending at P25. The two concave section are connected by a tangent line extending between points P23 and P24. The first concave section has a radius of curvature R11 at center C11 and the second concave section has a radius of curvature R12 at center C12.

The lowermost disc tang 84 is defined by a first straight section beginning and ending at P25 and P26, respectively, a second straight section beginning and ending at P27 and P28, respectively, and a third straight section beginning and ending at P29 and P30, respectively. The first and second straight sections are joined by a tangent convex section having a radius of curvature R13 at center C13 and the second and third straight sections are joined by a tangent convex section having a radius of curvature R14 at center C14. The lowermost disc groove 88 is defined by a first concave section beginning at P30 and ending at P31 and a second concave section beginning at P32 and ending at P33. The two concave section are connected by a tangent line extending between points P31 and P32. The first concave section has a radius of curvature R15 at center C15 and the second concave section has a radius of curvature R16 at center C16.

As in the case of the blade root 12, 30° is the optimum value for the angle that the disc tang bearing surfaces make with the X-direction.

Tables VI and VII give the corresponding values for the points and radii of curvature that define the disc groove 80. As before, although the coordinates and radii are shown for only the right hand side of the slot 80, it should be understood that the slot is symmetrical about the its radial centerline, defined by the Y-axis, so that Tables VI and VII completely define the disc slot 80 geometry. In one preferred embodiment of the invention, the value of the coordinate points and the radii show in Tables VI and VII are expressed in inches. However, it should be understood that the disc slot 80 according to the current invention may be scaled to greater or lesser sizes provided that the shape remains the same. Accordingly, the values for the coordinates and radii given in Tables VI and VII should be considered as being non-dimensional.

TABLE VI

| Point | Disc Slot Coordinates X | Y |
|---|---|---|
| P1 | −1.250 | 1.066 |
| P2 | −1.004 | 1.066 |
| P3 | −0.762 | 0.722 |
| P4 | −0.761 | 0.715 |
| P5 | −0.884 | 0.456 |
| P6 | −1.066 | 0.351 |
| P7 | −1.132 | 0.196 |
| P8 | −1.107 | 0.097 |
| P9 | −1.028 | 0.012 |
| P10 | −0.690 | −0.100 |
| P11 | −0.614 | −0.197 |
| P12 | −0.611 | −0.242 |
| P13 | −0.697 | −0.402 |
| P14 | −0.865 | −0.499 |
| P15 | −0.937 | −0.701 |
| P16 | −0.918 | −0.749 |
| P17 | −0.850 | −0.814 |
| P18 | −0.520 | −0.923 |
| P19 | −0.441 | −1.019 |
| P20 | −0.432 | −1.093 |
| P21 | −0.493 | −1.214 |
| P22 | −0.653 | −1.306 |
| P23 | −0.734 | −1.493 |
| P24 | −0.711 | −1.589 |
| P25 | −0.638 | −1.669 |
| P26 | −0.386 | −1.752 |
| P27 | −0.324 | −1.838 |
| P28 | −0.324 | −2.068 |
| P29 | −0.341 | −2.097 |
| P30 | −0.464 | −2.168 |
| P31 | −0.557 | −2.384 |
| P32 | −0.524 | −2.522 |
| P33 | −0.252 | −2.737 |
| P34 | 0.000 | −2.737 |

TABLE VII

| Radius | Value | Disc Slot Radii Center Coordinates X | Y |
|---|---|---|---|
| R1 | 0.48 | −1.236 | 0.646 |
| R2 | 0.25 | −1.011 | 0.675 |
| R3 | 0.14 | −0.996 | 0.230 |
| R4 | 0.12 | −0.991 | 0.126 |
| R5 | 0.11 | −0.724 | −0.205 |
| R6 | 0.17 | −0.783 | −0.253 |
| R7 | 0.17 | −0.783 | −0.642 |
| R8 | 0.11 | −0.815 | −0.710 |
| R9 | 0.12 | −0.556 | −1.033 |
| R10 | 0.12 | −0.554 | −1.107 |
| R11 | 0.17 | −0.568 | −1.454 |
| R12 | 0.11 | −0.604 | −1.565 |
| R13 | 0.09 | −0.414 | −1.838 |
| R14 | 0.03 | −0.357 | −2.068 |
| R15 | 0.20 | −0.366 | −2.339 |
| R16 | 0.28 | −0.252 | −2.457 |

Although the present invention has been disclosed with reference to the last row of blades in a steam turbine, the invention is also applicable to other rows in a steam turbine or to other types of turbo-machines, such as gas turbines. Accordingly, the present invention may be embodied in other specific forms without departing from the spirit or essential attributes thereof and, accordingly, reference should be made to the appended claims, rather than to the foregoing specification, as indicating the scope of the invention.

We claim:

1. A turbo-machine comprising:

a) a stationary cylinder for containing a steam flow, and a rotor enclosed by said cylinder; and b) a row of blades affixed to said rotor, each of said blades having an airfoil portion and a root portion, each of said airfoils having a leading edge and a trailing edge defining a chord therebetween, said airfoil having a base at its proximal end adjacent said root and a tip at its distal end and a mid-height region disposed mid-way between said base and said tip, said chord decreasing from said base to said mid-height region and being essentially constant from said mid-height region to said tip; wherein said chord at said mid-height region is less than one half of said chord at said base.

2. The turbo-machine according to claim 1, wherein said chord decreases approximately linearly from said base to said mid-height region.

3. The turbo-machine according to claim 1, wherein each of said airfoils has a 25% height region disposed mid-way between said base and said mid-height region and a 75% height region disposed mid-way between said mid-height region and said tip, and wherein each of said airfoils is defined by the following parameters having approximately the values indicated below, all angles being expressed in degrees:

| Parameter | 25% | Mid | 75% | Tip |
|---|---|---|---|---|
| Radius, cm | 94.0 | 116.8 | 139.7 | 162.6 |
| Width, cm | 25.0 | 14.3 | 6.60 | 2.06 |
| Chord, cm | 25.5 | 19.0 | 18.4 | 18.5 |
| Pitch/chord | 0.45 | 0.76 | 0.94 | 0.97 |
| Stagger Angle | 10.3 | 40.8 | 69.3 | 84.4 |
| Max Thickness, cm | 3.88 | 2.49 | 1.16 | 0.90 |
| Max Thickness/Chord | 0.15 | 0.13 | 0.06 | 0.05 |
| Max Thickness/Pitch | 0.34 | 0.17 | 0.07 | 0.05 |
| Turning Angle | 94.0 | 74.6 | 13.7 | 0.7 |
| Exit Opening, cm | 6.30 | 6.46 | 4.78 | — |
| Exit Opening Angle | 36.1 | 33.8 | 24.9 | — |
| Gauging | 0.54 | 0.45 | 0.28 | — |
| Inlet Metal Angle | 50.0 | 77.8 | 149.8 | 175.7 |
| Inlet Included Angle | 9.2 | 16.0 | 11.0 | 2.6 |
| Exit Metal Angle | 36.0 | 27.6 | 16.5 | 3.6 |
| Suction Surface Turning Angle | 0.1 | 2.8 | 8.4 | 1.9 |

4. The turbo-machine according to claim 1, wherein:

a) each of said roots has (i) an uppermost tang, (ii) a next to uppermost tang adjacent said uppermost tang, (iii) a lowermost tang, and (iv) a next to lowermost tang adjacent said lowermost tang;

b) each of said roots has (i) an uppermost groove disposed between said uppermost tang and said airfoil, (ii) a next to uppermost groove disposed between said uppermost tang and said next to uppermost tang, (iii) a next to lowermost groove disposed between said next to lowermost tang and said next to uppermost tang, and (iv) a lowermost groove disposed between said next to lowermost tang and said lowermost tang;

c) each of said grooves is defined by a first concave section beginning at a first point and ending at second point and a second concave section beginning at a third point and ending at fourth point, said first and second concave sections being connected by a line tangent thereto extending between said second and third points; and d) each of said tangs is defined by a first straight section beginning at said fourth point and ending at a fifth point and a second straight section beginning at a sixth point and ending at a seventh point, and a third straight section beginning at an eighth point and ending at a ninth point, said first and second straight sections being joined by a first convex section tangent thereto, and said second and third straight sections being joined by a second convex section tangent thereto.

5. The turbo-machine according to claim 4, wherein each of said roots has first and second sides, said sides being symmetric about a radial centerline, said first side having a profile with a shape defined by points P1 to P34 located with reference to X–Y coordinate axes, said Y-axis being said radial centerline, as follows:

| Point | X | Y |
|---|---|---|
| P1 | −1.250 | 1.083 |
| P2 | −1.002 | 1.088 |
| P3 | −.754 | 0.731 |
| P4 | −.753 | 0.730 |
| P5 | −.884 | 0.456 |
| P6 | −1.066 | 0.351 |
| P7 | −1.128 | 0.203 |
| PB | −1.101 | 0.092 |
| P9 | −1.035 | 0.021 |
| P10 | −0.686 | −0.094 |
| P11 | −0.604 | −0.201 |
| P12 | −0.602 | −0.226 |
| P13 | −0.697 | −0.402 |
| P14 | −0.865 | −0.499 |
| P15 | −0.934 | −0.694 |
| P16 | −0.914 | −0.747 |
| P17 | −0.852 | −0.806 |
| P18 | −0.502 | −0.922 |
| P19 | −0.422 | −1.014 |
| P20 | −0.416 | −1.046 |
| P21 | −0.493 | −1.214 |
| P22 | −0.654 | −1.306 |
| P23 | −0.727 | −1.478 |
| P24 | −0.700 | −1.592 |
| P25 | −0.634 | −1.664 |
| P26 | −0.382 | −1.747 |
| P27 | −0.301 | −1.838 |
| P28 | −0.278 | −1.959 |
| P29 | −0.340 | −2.096 |
| P30 | −0.464 | −2.168 |
| P31 | −0.547 | −2.361 |
| P32 | −0.511 | −2.515 |
| P33 | −0.253 | −2.719 |
| P34 | 0.000 | −2.719 |

6. The turbo-machine according to claim 5, wherein said points P2 and P3 are connected by a concave section having a radius of curvature R1, said points P4 and P5 are connected by a concave section having a radius of curvature R2, said points P6 and P7 are connected by a convex section having a radius of curvature R3, said points P8 and P9 are connected by a convex section having a radius of curvature R4, said points P10 and P11 are connected by a concave section having a radius of curvature R5, said points P12 and P13 are connected by a concave section having a radius of curvature R6, said points P14 and P15 are connected by a convex section having a radius of curvature R7, said points P16 and P17 are connected by a convex section having a radius of curvature R8, said points P18 and P19 are connected by a concave section having a radius of curvature R9, said points P20 and P21 are connected by a concave section having a radius of curvature RI0, said points P22 and P23 are connected by a convex section having a radius of curvature R11 , said points P24 and P25 are connected by a convex section having a radius of curvature R12, said points P26 and P27 are connected by a concave section having a radius of curvature R13, said points P28 and P29 are connected by a concave section having a radius of curvature R14, said points P30 and P31 are connected by a convex section having a radius of curvature R15, said points P32 and P33 are connected by a convex section having a radius of curvature R16, said radii of curvature R1 to R16 having values and having centers located with reference to said X–Y axes as follows:

| | | Center Coordinates | |
|---|---|---|---|
| Radius | Value | X | Y |
| R1 | 0.49 | −1.226 | 0.654 |
| R2 | 0.27 | −1.018 | 0.688 |
| R3 | 0.13 | −0.999 | 0.235 |
| R3 | 0.10 | −1.004 | 0.116 |
| R4 | 0.12 | −0.724 | −0.208 |
| R5 | 0.19 | −0.792 | −0.238 |
| R6 | 0.16 | −0.785 | −0.638 |
| R7 | 0.10 | −0.821 | −0.711 |
| R8 | 0.12 | −0.540 | −1.036 |
| R9 | 0.16 | −0.573 | −1.076 |
| R10 | 0.16 | −0.575 | −1.442 |
| R11 | 0.10 | −0.603 | −1.569 |
| R12 | 0.12 | −0.419 | −1.861 |
| R13 | 0.13 | −0.405 | −1.984 |
| R14 | 0.18 | −0.376 | −2.321 |
| R15 | 0.27 | −0.253 | −2.454 |

7. A turbo-machine comprising:

a) a stationary cylinder for containing a steam flow, and a rotor enclosed by said cylinder;

b) a row of blades affixed to said rotor, each of said blades having an airfoil portion and a root portion:

(i) each of said roots having (A) an uppermost tang, (B) a next to uppermost tang adjacent to said uppermost tang, (C) a lowermost tang, and (C) a next to lowermost tang adjacent to said lowermost tang, (ii) each of said roots having (A) an uppermost groove disposed above said uppermost tang, (B) a next to uppermost groove disposed between said uppermost tang and said next to uppermost tang, (C) a next to lowermost groove disposed between said next to lowermost tang and said next to uppermost tang, and (D) a lowermost groove disposed between said next to lowermost tang and said lowermost tang, whereby each of said grooves is immediately above one of said tangs, (iii) each of said grooves being defined by (A) a first concave section beginning at a first point and ending at second point and (B) a second concave section beginning at third point and ending at fourth point, said first and second concave sections being connected by a line tangent thereto extending between said second and third points, and (iv) each of said tangs being defined by (A) a first straight section beginning at said fourth point of the one of said grooves immediately above said tang and ending at a fifth point, (B) a second straight section beginning at a sixth point and ending at an seventh point, and (C) a third straight section beginning at an eighth point and ending at a ninth point, said first and second straight sections being joined by a first convex section tangent thereto and said second and third straight sections being joined by a second convex section tangent thereto.

8. The turbo-machine according to claim 7, wherein each of said roots has first and second sides, said sides being symmetric about a radial centerline, said first side having a profile with a shape defined points P1 to P34 located with reference to X–Y coordinate axes, said Y-axis being said radial centerline, as follows:

| Point | X | Y |
|---|---|---|
| P1 | −1.250 | 1.083 |
| P2 | −1.002 | 1.088 |
| P3 | −.754 | 0.731 |
| P4 | −.753 | 0.730 |
| P5 | −.884 | 0.456 |
| P6 | −1.066 | 0.351 |
| P7 | −1.128 | 0.203 |
| P8 | −1.101 | 0.092 |
| P9 | −1.035 | 0.021 |
| P10 | −0.686 | −0.094 |
| P11 | −0.604 | −0.201 |
| P12 | −0.602 | −0.226 |
| P13 | −0.697 | −0.402 |
| P14 | −0.865 | −0.499 |
| P15 | −0.934 | −0.694 |
| P16 | −0.914 | −0.747 |
| P17 | −0.852 | −0.806 |
| P18 | −0.502 | −0.922 |
| P19 | −0.422 | −1.014 |
| P20 | −0.416 | −1.046 |
| P21 | −0.493 | −1.214 |
| P22 | −0.654 | −1.306 |
| P23 | −0.727 | −1.478 |
| P24 | −0.700 | −1.592 |
| P25 | −0.634 | −1.664 |
| P26 | −0.382 | −1.747 |
| P27 | −0.301 | −1.838 |
| P28 | −0.278 | −1.959 |
| P29 | −0.340 | −2.096 |
| P30 | −0.464 | −2.168 |
| P31 | −0.547 | −2.361 |
| P32 | −0.511 | −2.515 |
| P33 | −0.253 | −2.719 |
| P34 | 0.000 | −2.719 |

9. The turbo-machine according to claim 9, wherein each of said points P2 and P3 are connected by a concave section having a radius of curvature R1, said points P4 and P5 are connected by a concave section having a radius of curvature R2, said points P6 and P7 are connected by a convex section having a radius of curvature R3, said points P8 and P9 are connected by a convex section having a radius of curvature R4, said points P10 and P11 are connected by a concave section having a radius of curvature R5, said points P12 and P13 are connected by a concave section having a radius of curvature R6, said points P14 and P15 are connected by a convex section having a radius of curvature R7, said points P16 and P17 are connected by a convex section having a radius of curvature R8, said points P18 and P19 are connected by a concave section having a radius of curvature R9, said points P20 and P21 are connected by a concave section having a radius of curvature R10, said points P22 and P23 are connected by a convex section having a radius of curvature R11, said points P24 and P25 are connected by a convex section having a radius of curvature R12, said points P26 and P27 are connected by a concave section having a radius of curvature R13, said points P28 and P29 are connected by a concave section having a radius of curvature R14, said points P30 and P31 are connected by a convex section having a radius of curvature R15, said points P32 and P33 are connected by a convex section having a radius of curvature R16, said radii of curvature R1 to R16 having values and centers located with reference to said X–Y axes as follows:

| | | Center Coordinates | |
|---|---|---|---|
| Radius | Value | X | Y |
| R1 | 0.49 | 1.226 | 0.654 |
| R2 | 0.27 | −1.018 | 0.688 |
| R3 | 0.13 | −0.999 | 0.235 |
| R4 | 0.10 | −1.004 | 0.116 |
| R5 | 0.12 | −0.724 | −0.208 |
| R6 | 0.19 | −0.792 | −0.238 |
| R7 | 0.16 | −0.785 | −0.638 |
| R8 | 0.10 | −0.821 | −0.711 |
| R9 | 0.12 | −0.540 | −1.036 |
| R10 | 0.16 | −0.573 | −1.076 |
| R11 | 0.16 | −0.575 | −1.442 |
| R12 | 0.10 | −0.603 | −1.569 |
| R13 | 0.12 | −0.419 | −1.861 |
| R14 | 0.13 | −0.405 | −1.984 |
| R15 | 0.18 | −0.376 | −2.321 |
| R16 | 0.27 | −0.253 | −2.454 |

10. The turbo-machine according to claim 7, wherein each of said airfoils has a base at its proximal end adjacent said root and a tip at its distal end and mid-height region disposed mid-way between said base and said tip, and a 25% height region disposed mid-way between said base and said mid-height region, and a 75% height region disposed mid-way between said mid-height region and said tip, each of said airfoils being defined by the following parameters having approximately the values indicated below, all angles being expressed in degrees:

| Parameter | 25% | Mid | 75% | Tip |
|---|---|---|---|---|
| Radius, cm | 94.0 | 116.8 | 139.7 | 162.6 |
| Width, cm | 25.0 | 14.3 | 6.60 | 2.06 |
| Chord, cm | 25.5 | 19.0 | 18.4 | 18.5 |
| Pitch/Chord | 0.45 | 0.76 | 0.94 | 0.97 |
| Stagger Angle | 10.3 | 40.8 | 69.3 | 84.4 |
| Max Thickness, cm | 3.88 | 2.49 | 1.16 | 0.90 |
| Max Thickness/Chord | 0.15 | 0.13 | 0.06 | 0.05 |
| Max Thickness/Pitch | 0.34 | 0.17 | 0.07 | 0.05 |
| Turning Angle | 94.0 | 74.6 | 13.7 | 0.7 |
| Exit Opening, cm | 6.30 | 6.46 | 4.78 | — |
| Exit Opening, Angle | 36.1 | 33.8 | 24.9 | |
| Gauging | 0.54 | 0.45 | 0.28 | — |
| Inlet Metal Angle | 50.0 | 77.8 | 149.8 | 175.7 |
| Inlet Included Angle | 9.2 | 16.0 | 11.0 | 2.6 |
| Exit Metal Angle | 36.3 | 27.6 | 16.5 | 3.6 |
| Suction Surface Turning Angle | 0.1 | 2.8 | 8.4 | 1.9 |

11. The turbo-machine according to claim 7, wherein said rotor has a plurality of slots for retaining said blade roots, each of said slots having first and second sides, said sides being symmetric about a radial centerline, said first side having a profile with a shape defined by points P1 to P34 located with reference to X–Y coordinate axes, said Y-axis being said radial centerline, as follows:

| Point | X | Y |
|---|---|---|
| P1 | −1.250 | 1.066 |
| P2 | −1.004 | 1.066 |
| P3 | −0.762 | 0.722 |
| P4 | −0.761 | 0.715 |
| PS | −0.894 | 0.456 |
| P6 | −1.066 | 0.351 |
| P7 | −1.132 | 0.196 |
| P8 | −1.107 | 0.097 |
| P9 | −1.028 | 0.012 |
| P10 | −0.690 | −0.100 |
| P11 | −0.614 | −0.197 |
| P12 | −0.611 | −0.242 |
| P13 | −0.697 | −0.402 |
| P14 | −0.865 | −0.499 |
| P15 | −0.937 | −0.701 |
| P16 | −0.918 | −0.749 |
| P17 | −0.950 | −0.814 |
| P18 | −0.520 | −0.923 |
| P19 | −0.441 | −1.019 |
| P20 | −0.432 | −1.093 |
| P21 | −0.493 | −1.214 |
| P22 | −0.653 | −1.306 |
| P23 | −0.734 | −1.493 |
| P24 | −0.711 | −1.589 |
| P25 | −0.638 | −1.669 |
| P26 | −0.386 | −1.752 |
| P27 | −0.324 | −1.838 |
| P28 | −0.324 | −2.207 |
| P29 | −0.341 | −2.097 |
| P30 | −0.464 | −2.168 |
| P31 | −0.557 | −2.394 |
| P32 | −0.524 | −2.522 |
| P33 | −0.252 | −2.737 |
| P34 | 0.000 | −2.737 |

12. The turbo-machine according to claim 11, wherein each of said points P2 and P3 are connected by a convex section having a radius of curvature R1, said points P4 and P5 are connected by a convex section having a radius of curvature R2, said points P6 and P7 are connected by a concave section having a radius of curvature R3, said points P8 and P9 are connected by a concave section having a radius of curvature R4, said points P10 and P11 are connected by a convex section having a radius of curvature R5, said points P12 and P13 are connected by a convex section having a radius of curvature R6, said points P14 and P15 are connected by a concave section having a radius of curvature R7, said points P16 and P17 are connected by a concave section having a radius of curvature R8, said points P18 and P19 are connected by a convex section having a radius of curvature R9, said points P20 and P21 are connected by a convex section having a radius of curvature R10, said points P22 and P23 are connected by a concave section having a radius of curvature R11, said points P24 and P25 are connected by a concave section having a radius of curvature R12, said points P26 and P27 are connected by a convex section having a radius of curvature R13, said points P28 and P29 are connected by a convex section having a radius of curvature R14, said points P30 and P31 are connected by a concave section having a radius of curvature R15, said points P32 and P33 are connected by a concave section having a radius of curvature R16, said radii of curvature R1 to R16 having values and centers located with reference to said X–Y axes as follows:

| | | Center Coordinates | |
|---|---|---|---|
| Radius | Value | X | Y |
| R1 | 0.48 | −1.236 | 0.646 |
| R2 | 0.25 | −1.011 | 0.675 |
| R3 | 0.14 | −0.996 | 0.230 |
| R4 | 0.12 | −0.991 | 0.126 |
| R5 | 0.11 | −0.724 | −0.205 |
| R6 | 0.17 | −0.783 | −0.253 |
| R7 | 0.17 | −0.783 | −0.642 |
| R8 | 0.11 | −0.815 | −0.710 |
| R9 | 0.12 | −0.556 | −1.033 |
| R10 | 0.12 | −0.554 | −1.107 |
| R11 | 0.17 | −0.568 | −1.454 |
| R12 | 0.11 | −0.604 | −1.565 |
| R13 | 0.09 | −0.414 | −1.838 |
| R14 | 0.03 | −0.357 | −2.068 |
| R15 | 0.20 | −0.366 | −2.339 |
| R16 | 0.28 | −0.252 | −2.457 |

13. The turbo-machine according to claim 7, wherein said first straight section of each of said tangs defines an angle with an axis perpendicular to the radial direction, said angle being approximately 30°.

14. A row of rotating blades for a steam turbine, each of comprising an airfoil portion and a root portion, said airfoil having a leading edge and a trailing edge defining a chord therebetween, said airfoil having a base at its proximal end adjacent said root and a tip at its distal end and a mid-height region disposed mid-way between said base and said tip, said chord decreasing from said base to said mid-height region and being essentially constant from said mid-height region to said tip; wherein said chord at said mid-height region is less than one half of said chord at said base.

15. The row of rotating blades according to claim 14, wherein said chord decreases approximately linearly from said base to said mid-height region.

16. The row of rotating blades according to claim 14, wherein each of said airfoils has a 25% height region disposed mid-way between said base and said mid-height region and a 75% height region disposed mid-way between said mid-height region and said tip, and wherein each of said airfoils is defined by the following parameters having approximately the values indicated below, all angles being expressed in degrees:

| Parameter | 25% | Mid | 75% | Tip |
|---|---|---|---|---|
| Radius, cm | 94.0 | 116.8 | 139.7 | 162.6 |
| Width, cm | 25.0 | 14.3 | 6.60 | 2.06 |
| Chord, cm | 25.5 | 19.0 | 18.4 | 18.5 |
| Pitch/Chord | 0.45 | 0.76 | 0.94 | 0.97 |
| Stagger Angle | 10.3 | 40.8 | 69.3 | 94.4 |
| Max Thickness, cm | 3.88 | 2.49 | 1.16 | 0.90 |
| Max Thickness/Chord | 0.15 | 0.13 | 0.06 | 0.05 |
| Max Thickness/Pitch | 0.34 | 0.17 | 0.07 | 0.05 |
| Turning Angle | 94.0 | 74.6 | 13.7 | 0.7 |
| Exit Opening, cm | 6.30 | 6.46 | 4.78 | — |
| Exit Opening, Angle | 36.1 | 33.8 | 24.9 | — |
| Gauging | 0.54 | 0.45 | 0.28 | |
| Inlet Metal Angle | 50.0 | 77.8 | 149.8 | 175.7 |
| Inlet Included Angle | 9.2 | 16.0 | 11.0 | 2.6 |
| Exit Metal Angle | 36.3 | 27.6 | 16.5 | 3.6 |
| Suction Surface Turning Angle | 0.1 | 2.8 | 8.4 | 1.9 |

17. The row of rotating blades according to claim 14, wherein:

a) each of said roots has (i) an uppermost tang, (ii) a next to uppermost tang adjacent said uppermost tang, (iii) a lowermost tang, and (iv) a next to lowermost tang adjacent said lowermost tang;

b) each of said roots has (i) an uppermost groove disposed between said uppermost tang and said airfoil, (ii) a next to uppermost groove disposed between said uppermost tang and said next to uppermost tang, (iii) a lowermost groove disposed between said next to lowermost tang and said lowermost tang, and (iv) a next to lowermost groove disposed between said next to lowermost tang and said next to uppermost tang;

c) each of said grooves is defined by a first concave section beginning at a first point and ending at second point and a second concave section beginning at a third point and ending at fourth point, said first and second concave sections being connected by a tangent line tangent thereto extending between said second and third points; and d) each of said tangs is defined by a first straight section beginning at said fourth point and ending at a fifth point and a second straight section beginning at a sixth point and ending at an seventh point, and a third straight section beginning at an eighth point and ending at a ninth point, said first and second straight sections being joined by a first convex section tangent thereto, and said second and third straight sections being joined by a second convex section tangent thereto.

18. The row rotating blades according to claim 17, wherein each of said roots has first and second sides, said sides being symmetric about a radial centerline, said first side having a profile defined by points P1 to P34 located with reference to X–Y coordinate axes, said Y-axis being said radial centerline, as follows:

| Point | X | Y |
|---|---|---|
| P1 | −1.250 | 1.083 |
| P2 | −1.002 | 1.088 |
| P3 | −.754 | 0.731 |
| P4 | −.753 | 0.730 |
| P5 | −.884 | 0.456 |
| P6 | −1.066 | 0.351 |
| P7 | −1.128 | 0.203 |
| P8 | −1.101 | 0.092 |
| P9 | −1.035 | 0.021 |
| P10 | −0.696 | −0.094 |
| P11 | −0.604 | −0.201 |
| P12 | −0.602 | −0.226 |
| P13 | −0.697 | −0.402 |
| P14 | −0.865 | −0.499 |
| P15 | −0.934 | −0.694 |
| P16 | −0.914 | −0.747 |
| P17 | −0.952 | −0.806 |
| P18 | −0.502 | −0.922 |
| P19 | −0.422 | −1.014 |
| P20 | −0.416 | −1.046 |
| P21 | −0.493 | −1.214 |
| P22 | −0.654 | −1.306 |
| P23 | −0.727 | −1.478 |
| P24 | −0.700 | −1.592 |
| P25 | −0.634 | −1.664 |
| P26 | −0.382 | −1.747 |
| P27 | −0.301 | −1.838 |
| P28 | −0.278 | −1.959 |
| P29 | −0.340 | −2.096 |
| P30 | −0.464 | −2.168 |

-continued

| Point | X | Y |
|---|---|---|
| P31 | −0.547 | −2.361 |
| P32 | −0.511 | −2.515 |
| P33 | −0.253 | −2.719 |
| P34 | 0.000 | −2.719 |

19. The row of rotating blades according to claim 18, wherein said points P2 and P3 are connected by a concave section having a radius of curvature R1, said points P4 and P5 are connected by a concave section having a radius of curvature R2, said points P6 and P7 are connected by a convex section having a radius of curvature R3, said points P8 and P9 are connected by a convex section having a radius of curvature R4, said points P10 and P11 are connected by a concave section having a radius of curvature R5, said points P12 and P13 are connected by a concave section having a radius of curvature R6, said points P14 and P15 are connected by a convex section having a radius of curvature R7, said points P16 and P17 are connected by a convex section having a radius of curvature R8, said points P18 and P19 are connected by a concave section having a radius of curvature R9, said points P20 and P21 are connected by a concave section having a radius of curvature R10, said points P22 and P23 are connected by a convex section having a radius of curvature R11, said points P24 and P25 are connected by a convex section having a radius of curvature R12, said points P26 and P27 are connected by a concave section having a radius of curvature R13, said points P28 and P29 are connected by a concave section having a radius of curvature R14, said points P30 and P31 are connected by a convex section having a radius of curvature R15, said points P32 and P33 are connected by a convex section having a radius of curvature R16, said radii of curvature R1 to R16 having values and having centers located with reference to said X–Y axes as follows:

| | | Center Coordinates | |
|---|---|---|---|
| Radius | Value | X | Y |
| R1 | 0.49 | −1.226 | 0.654 |
| R2 | 0.27 | −1.018 | 0.688 |
| R3 | 0.13 | −0.999 | 0.235 |
| R4 | 0.10 | −1.004 | 0.116 |
| R5 | 0.12 | −0.724 | −0.208 |
| R6 | 0.19 | −0.792 | −0.238 |
| R7 | 0.16 | −0.785 | −0.638 |
| R8 | 0.10 | −0.821 | −0.711 |
| R9 | 0.12 | −0.540 | −1.036 |
| R10 | 0.16 | −0.573 | −1.076 |
| R11 | 0.16 | −0.575 | −1.442 |
| R12 | 0.10 | −0.603 | −1.569 |
| R13 | 0.12 | −0.419 | −1.861 |
| R14 | 0.13 | −0.405 | −1.984 |
| R15 | 0.18 | −0.376 | −2.321 |
| R16 | 0.27 | −0.253 | −2.454 |

* * * * *